US006694858B2

(12) United States Patent
Grimes

(10) Patent No.: US 6,694,858 B2
(45) Date of Patent: Feb. 24, 2004

(54) RECIRCULATING LINEAR GAS DRIVE SYSTEM

(75) Inventor: Edward C. Grimes, Calgary (CA)

(73) Assignee: CDK Services Ltd., Calgary (CA)

( * ) Notice: Subject to any disclaimer, the term of this patent is extended or adjusted under 35 U.S.C. 154(b) by 0 days.

(21) Appl. No.: 10/231,928

(22) Filed: Aug. 29, 2002

(65) Prior Publication Data

US 2003/0121405 A1 Jul. 3, 2003

(30) Foreign Application Priority Data

Aug. 29, 2001 (CA) ..... 2357533

(51) Int. Cl.[7] ..... F03G 7/04

(52) U.S. Cl. ..... 91/299; 91/317; 91/350; 166/68.5

(58) Field of Search ..... 60/412, 372; 91/247, 91/317, 350, 299; 166/68.5, 75.11

(56) References Cited

U.S. PATENT DOCUMENTS

| | | | | |
|---|---|---|---|---|
| 1,565,884 A | * | 12/1925 | Aikman | 91/317 |
| 1,571,560 A | * | 2/1926 | Smith et al. | 91/317 |
| 2,745,386 A | * | 5/1956 | Wildeman | 91/317 |
| 3,643,432 A | * | 2/1972 | Laeger | 60/412 |
| 3,801,230 A | | 4/1974 | Brown | |
| 3,901,313 A | | 8/1975 | Doniguian et al. | |
| 4,369,373 A | | 1/1983 | Wiseman | |
| 4,439,114 A | | 3/1984 | Kimmell | |
| 4,616,981 A | | 10/1986 | Simmons et al. | |
| 4,776,775 A | | 10/1988 | Conally | |
| 4,896,505 A | | 1/1990 | Holleyman | |
| 6,113,357 A | | 9/2000 | Dobbs | |
| 6,336,389 B1 | | 1/2002 | English et al. | |

OTHER PUBLICATIONS

Enviro Drive, Info Photos Contact, 6 pages.
ABI Oil Tools, E–Tronics Corp., Product Brochure, Zero Emission Blair Air System.

* cited by examiner

*Primary Examiner*—Thomas E. Lazo
(74) *Attorney, Agent, or Firm*—Blakely, Sokoloff, Taylor & Zafman LLP

(57) ABSTRACT

A system to provide mechanical energy to well-head equipment by directing pressurized gas existing in nearby pipelines to an engine. The engine is a linearly reciprocating piston in a closed cylinder driven by pressure differentials between the gas on either side of its piston, the differential being controlled by a switching valve which directs higher and lower pressured gas to the appropriate side of the piston, and which recirculates spent gas from the lower pressure side of the piston back to the pipeline. The system is a closed system, and avoids venting or flaring gas used in the engine.

7 Claims, 2 Drawing Sheets

RECIRCULATING LINEAR GAS DRIVE SYSTEM

The present application claims the benefit of the filing date of Canadian patent no. 2,357,533, filed Aug. 29, 2001.

FIELD OF THE INVENTION

The present invention relates to the field of providing gas drive to mechanical devices such as pumps and injectors at well-heads, using pressurized gas in a pipeline system, without the necessity of flaring or venting "spent" gas.

In particular, the present invention relates to a linear gas-driven system powered by pressure differential from produced gas to well-head gas without venting the gas spent or used in driving the system.

The invention has particular application (but is not thereby limited) in the field of gas production in the oil and gas industry, where it is often useful to provide power to energize well production equipment without resorting to externally (or remotely) supplied energy sources such as electrical power, and without using produced gas in internal combustion or other power-generating engines where waste products, heat, and maintenance are issues. The gas used is recirculated to the production line; the system is in that way a closed system.

BACKGROUND OF THE INVENTION

It is well known to provide for generation of mechanical power (such as powered reciprocal motion by reciprocating piston/cylinder/valve means or rotary motion by turbine, fan, or combined reciprocal piston/crank means) utilizing pressure differentials between produced gas well-head pressure and atmosphere; likewise between produced well-head gas pressures and sales line pressures. Engines in which power is derived from partially expanding pressurized fluid to drive an output shaft are generally preferred over internal combustion. See U.S. Pat. No. 3,801,230, U.S. Pat. No. 4,369,373, U.S. Pat. No. 4,896,505, and U.S. Pat. No. 6,113,357, which each provide means of harnessing either fluid flow or differential pressure to provide mechanically available power for other purposes.

The use of valves and pistons in combination with a fluid operated pressure-powered system is also known. See patents U.S. Pat. No. 4,439,114 and U.S. Pat. No. 4,616,981, which describe the use of pistons in combination with valves and fluid pressure in a pumping system.

It is also well known to provide for the injection of chemicals into a well bore to assist in the production of desired hydrocarbons or the protection of the well's equipment. See, for example, patents U.S. Pat. No. 3,901,313 and U.S. Pat. No. 4,776,775. Of course, the injection of material into a well (which is typically at higher than atmospheric pressure) requires the use of mechanical or pressure-providing power sources.

It is known in the art that such power sources may be provided by the use of pressure-differential between well-head produced gas pressures and atmosphere, with the spent gas (that is, once it is relieved to atmospheric pressures after powering the devices required) being released to atmosphere or flared. At current prices for hydrocarbons, in particular natural gases, and with current constraints on pollution of the atmosphere, these techniques are not ideally suited for today's use.

Engines that derive power from partially expanding pressurized fluid to drive equipment are preferred over internal combustion engines because of the absence of the involvement of volatile combustible fluids and the resulting exhaust gas which gives rise to pollution and safety concerns.

Several innovations have arisen due to those problems, such as the devices offered for sale and installation by ABI Oil Tools e-tronics Corp. under the trade name "Zero Emission Blair Air System", which powers a traditional venting glycol pump replacement with a closed-loop system in a containment device, depending upon the differential between well-head pressures and sales line pressures, which may be very high pressures, and may be very different pressures, and may be pressurized gases including corrosive or dangerous substances the release of which at high pressures could be problematic.

Another example of a similar containment device system is provided by the "Enviro Drive—the Environmental Alternative" system, which is a similarly powered, closed loop (that is, no escaping gases), production-to-sales line pressure-drop-driven injection pump (see "envirodrive-.com" web page as of Mar. 1, 2001).

It is therefore desirable to provide a source to energize equipment at the well-head in the form of reciprocating motion without venting or flaring exhaust gas. It is further desirable to provide such energizing motion without use of internal or other combustion of produced gas or fluids and without resort to externally provided power sources such as electricity, and without expensive external containment devices.

SUMMARY OF THE INVENTION

It is an object of this invention to overcome limitations in the prior art using internal or external combustion of fuel or sweet gas to drive pumps and to address safety and environmental issues related to such use. The existing prior art inadequately addresses the need for a recirculating linear gas drive system that utilizes pressurized gas, a simple closed valve and a piston drive system to drive a mechanical device, such as a pump, and that eliminates the need to routinely flare or release "spent" gas to atmosphere. None of the prior art discloses an invention that utilizes pressurized gas from a pipeline well-head, which is directed through a switching valve to drive a power unit with a piston to operate a pump.

This Invention relates to a system for providing drive to a mechanical well-head device by utilizing pressurized gas existing in a pipeline to power a unit containing a piston. This system provides for the use of pressurized gas within a pipeline system to provide gas drive to mechanical devices.

The invention is a system comprising:

- produced gas;
- a pipeline with gas at a lower pressure;
- a manifold with flow control valve;
- a reciprocating power unit;
- a drive connection from power unit to a powered unit; and
- a flow-directing switching means which, in time with the drive's reciprocating movement to the end-point positions, switches communication of produced gas and pipeline with the appropriate sides of the power unit which returns spent gas to the pipeline In particular, this invention in one embodiment is a system that provides the gas drive to a device using the pressurized gas in a pipeline, such as from the well-head, by directing that gas through a switching valve to a power unit containing a piston within a cylinder. The pressurized gas works against the piston, driving it through the length of the cylinder.

When the piston reaches the end of the stroke, the switching valve reverses the flow in the valve manifold, so that the piston is driven back in the opposite direction. At the end of the reverse stroke, the switching valve changes the flow direction and drives the piston forward to the end of the stroke. This process may be continuously maintained by an adjustable flow control means, and may be turned on or off or have its speed or power varied by the flow control means.

The Invention has particular application (but is not thereby limited) in the field of gas production in the oil and gas industry, where it is often useful to provide power to energize well production equipment without resorting to externally (remotely) supplied energy sources such as electrical power, and without using produced gas in internal combustion or other power-generation engines where waste products, heat, and maintenance are issues. The use of pressurized gas also assists in preventing the system from stalling and will cure difficulties overcoming the friction of the driver.

These and other objects and advantages of the Invention are apparent in the following descriptions of the preferred embodiments of the Invention, which are not intended to limit in any way the scope or the claims of the Invention.

BRIEF DESCRIPTION OF THE DRAWINGS

Preferred embodiments of the present invention will now be described, by way of example only, with reference to the attached Figures, wherein.

DETAILED DESCRIPTION OF THE INVENTION

The preferred embodiment of the Invention is comprised of high pressurized gas supplied from a pipeline well-head, pipe, a switching valve c/w manifold system for directing the gas flow, a power unit with piston and a driven injection pump.

Figure 1:
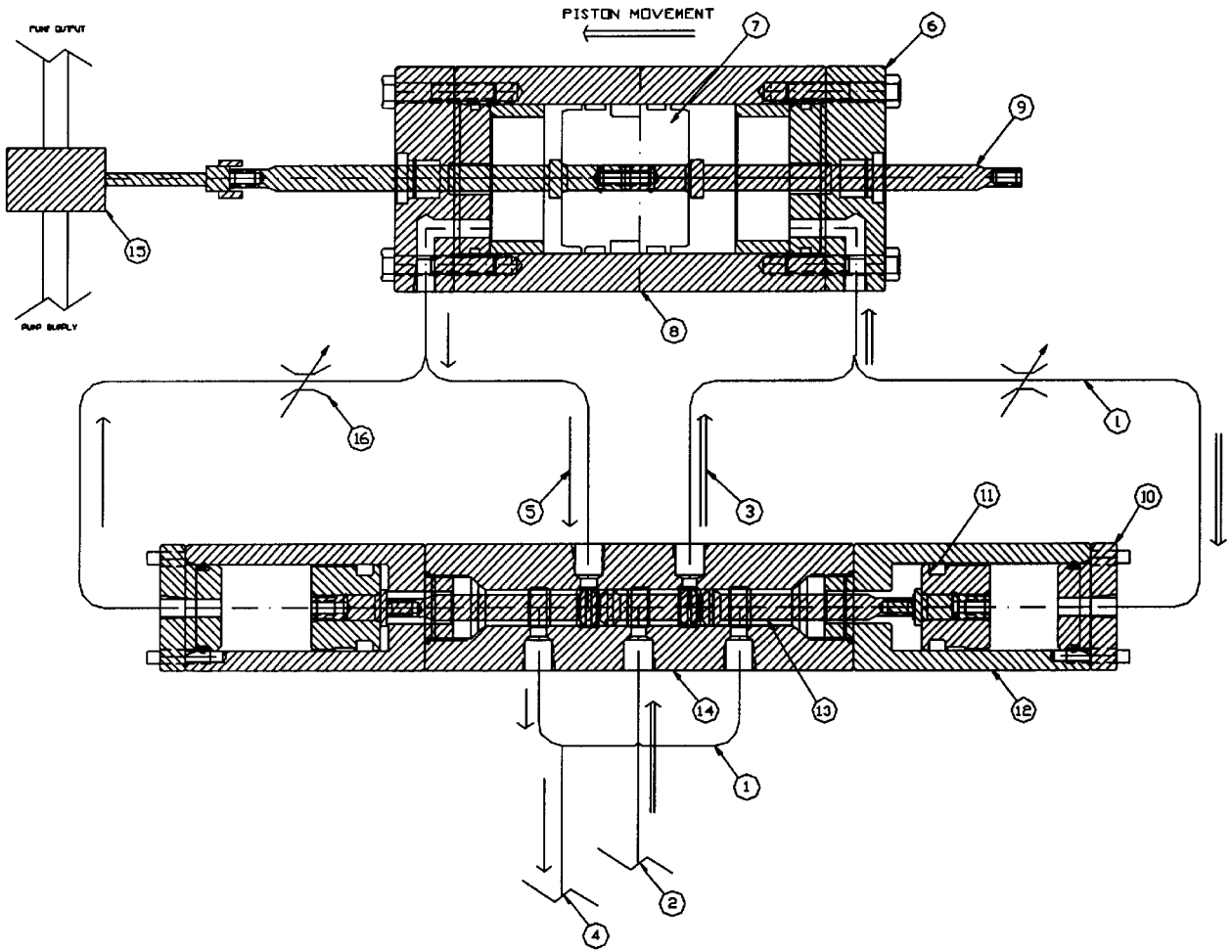
FIG. 1 is a schematic representation of valve-states, gas flow and drive motion directions
Figure 2:
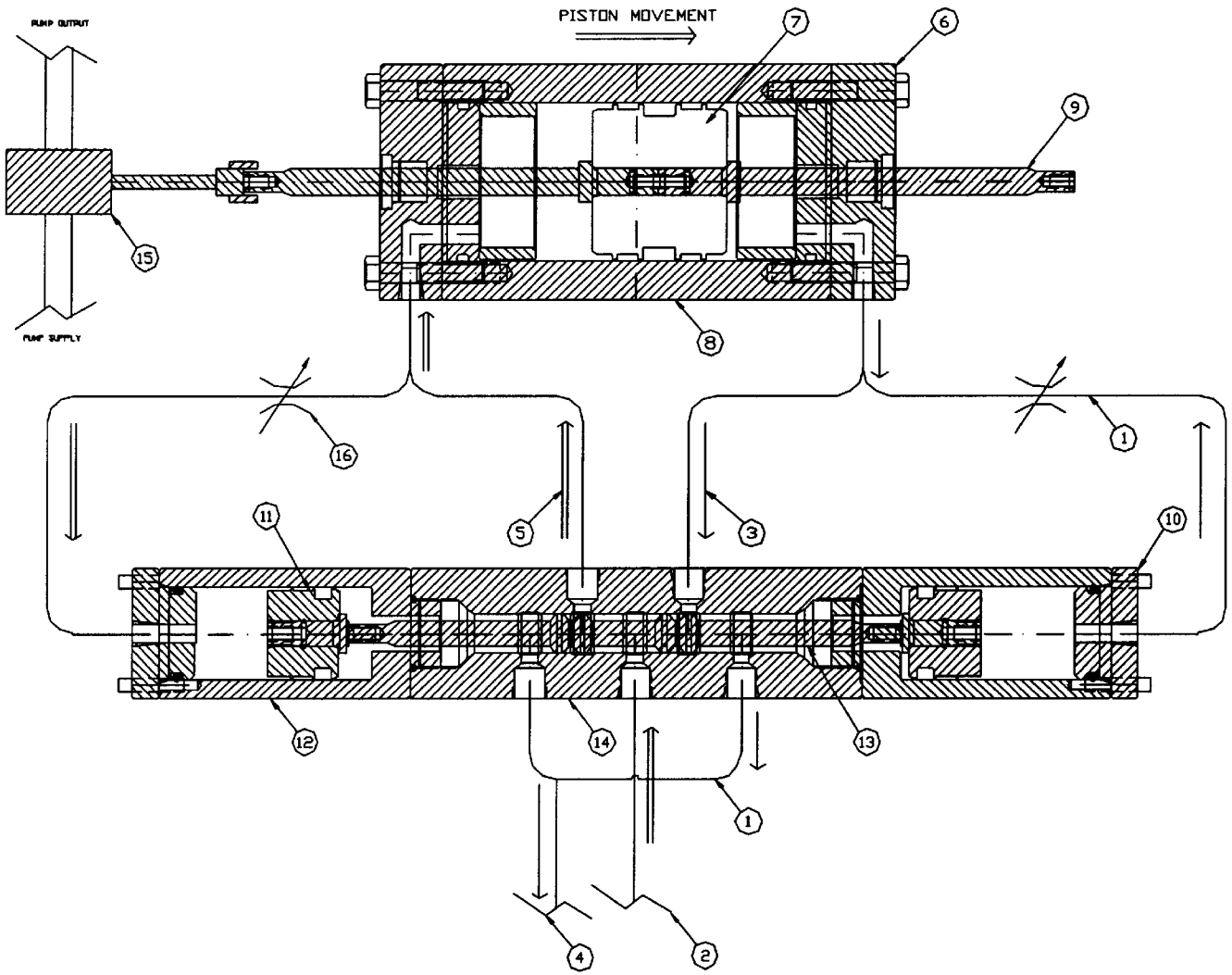
FIG. 2 is a similar schematic representation showing the valve-states and drive motions in its reciprocal state

FIGS. 1 and 2 illustrates a preferred embodiment of the Invention comprised of:

1—manifold

2—high pressure gas source

3—high pressure gas (produced gas)

4—low pressure gas outlet

5—low pressure gas

6—engine cylinder (double-acting) or power unit

7—engine or power unit piston

8—engine or power unit cylinder body

9—engine or power unit piston rod

10—switching valve,

11—switching valve piston

12—switching valve cylinder

13—switching valve body

14—switching valve manifold

15—driven pump or similar equipment

16—control valve

In FIG. 1:

The high-pressure or produced gas 3 is obtained from a high-pressure gas source 2, typically a conventional well-head with fittings and valves, blowout preventers and the like.

The high-pressure or produced gas 3 flows through the manifold 1 to the switching valve 10 and is directed by the body 13 of the switching valve 10, to one of the sides of the engine piston 7 in the double acting cylinder 6 of the engine or reciprocating power unit 6.

The produced gas 3 pushes the power unit piston 7 contained within the power unit cylinder body 8, transmitting the piston's 7 powered stroke through the engine piston rod 9 to the driven pump equipment 15.

At the same time, spent gas 3, contained in the opposite side of the double acting driver cylinder 6 is exhausted through the manifold and the switching valve 10 to the low-pressure outlet 4.

During approximately the same time, high-pressure gas 3 flows through the control valve 16 to one of the switching valve's cylinders 12 and pushes the switching valve piston 11 toward one end position.

The switching valve's piston 11 movement is transferred to the switching valve's body 13. The body 13 moves linearly within the switching valve's ported cylinder 14 closing one flow path and opening another, and thus reversing the flow of both spent and high pressure gas through the manifold 1.

Once the flow direction is reversed, the process may be continuously repeated.

In FIG. 2:

The high-pressure or produced gas 3, obtained from a high-pressure gas source 2, flows through the manifold 1 to the switching valve 10 and is directed by the body 13 of the switching valve 10, through its ported cylinder 14 to the opposite side of the double acting cylinder of the engine or power unit 6.

The high-pressure or produced gas 3 pushes the engine piston 7 transmitting the piston's powered stroke through the engine piston rod 9 to the driven pump equipment 15.

At the same time, spent gas 3, contained in the opposite side of the double acting engine cylinder 6, is exhausted through the switching valve 10 to the low-pressure gas outlet 4 to pipeline at lower pressure than the produced gas.

During approximately the same time, high-pressure gas 3 flows through the switching valve 16 to the second of the switching valve's cylinder bodies 12 which pushes the switching valve piston 11.

The switching valve piston 11 movement is transferred to the body 13. The body 13 moves linearly within the switching valve's ported cylinder 14 closing the flow path and opening another, altering the flow of high pressure gas and of spent gas.

The speed, power and time delays of the operation are controlled using adjustable flow control 16 and the stroke of the engine's piston 7 may be optimized by using variable length piston sleeves.

In one embodiment, the system comprises:

produced gas 3 a pipeline with gas at a lower pressure 5 a manifold 1 with flow control valve 16 a reciprocating power unit 6 a drive connection 9 from power unit 6 to a driven pump or other powered unit 15; and a flow-directing switching means 10 which, in time with the drive's reciprocating movement to the end-point positions, switches communication of produced gas 3 and pipeline 5 with the appropriate sides of the power unit 6.

The switching means in one embodiment comprises:

two opposed pistons 11 tightly fitted and moveable in a linear fashion within closed cylinders 12 each opposed piston 11 connected to the other via a body 13 between them which is itself tightly fitted and slideable within a fourth cylinder 12 fixed to both of said opposed piston's cylinders said body 13 having cavities which match with and form different conduits between five ports in said fourth cylinder 12 at different orientations of said body 13 within said fourth cylinder's 12 wall, each port communicating with said manifold 1 two flow control valves 16 deployed in the manifold 1, each control valve 16 to control the rate of gas flow between one side of the power unit's piston 7 and one side of the matching one of said opposed pistons 11 versus the other side of said opposed piston, to control the speed of reciprocation of said opposed pistons 11 and said body 13.

In that embodiment:

when said opposed pistons 11 are substantially at one extreme of their linear travel within their respective cylinders 12, said cavities and manifold 1 form the following communications paths:

produced gas 3 to the first side of said power unit piston 7 and directly to one side of a matching one of said opposing pistons 11, and through flow-control valve 16 to the other side of said one opposing piston 11 the other side of said power unit piston 7 and directly to one side of the matching second of said opposing pistons 11 and, through the second flow-control valve 16 from the other side of said second opposing piston 11, to pipeline 5 such that the power unit piston 7 is pushed in a direction from the produced gas side toward the pipeline side of its cylinder 6, providing power through its connecting rod 7 to the driven pump or other powered unit 15, and such that:

the opposing piston 11 communicating with pipeline 5 is moved from its directly communicating side toward its flow-control communicating side and spent gas from the power unit piston 7 then flows to pipeline 5 essentially simultaneously, the other opposing piston which is communicating with produced gas is pushed from its directly communicating side toward its flow-control communicating side which until then had contained gas at lower pipeline pressures, and said body 13 is moved toward one direction in relation to said ports to alter in a timed way the conduits thus formed within the manifold 1 and ported cylinder 12 and body 13 so that at the other extreme of their linear travel within their respective cylinders is caused the communications paths as follows:

produced gas to the second side of said power unit piston 7 and directly to one side of the matching second opposing piston 11 and through the second flow-control valve 16 to the other side of the second opposing piston 11 the first side of said power unit piston 7 and directly to one side of the matching first opposing piston 11 and through the first flow-control valve 11 to the other side of the first opposing piston 11, and to pipeline 5 such that the power unit piston 7 then is pushed in the other direction, providing repeatable reciprocating linear powered motion of said drive connection, and said reversed gas-flows provide realignment of said switching valve's internal body's cavities with said ports to cause the further repeated redirection of gas through the manifold.

In the same embodiment, the first and second flow-control valves 16 may be independently adjusted to vary the timing of the reciprocation, each such valve 16 controlling the rate of gas flow required to reach equilibrium between a produced gas side and a pipeline side of the power unit's piston 7 for a different direction of said reciprocation.

All components of the Invention may be comprised of any device and material suitable.

In the foregoing Description, the Invention has been described in its preferred embodiments. However, it will be evident that various modifications and changes may be made without departing from the broader scope and spirit of the Invention. Accordingly, the present specifications and embodiments are to be regarded as illustrative rather than restrictive.

The descriptions here are meant to be exemplary and not limiting. It is to be understood that a reader skilled in the art will derive from this descriptive material the concepts of this Invention, and that there are a variety of other possible implementation; substitution of different specific components for those mentioned here will not be sufficient to differ from the Invention described where the substituted components are functionally equivalent.

The above-described embodiments of the invention are intended to be examples of the present invention. Alterations, modifications and variations may be effected the particular embodiments by those of skill in the art, without departing from the scope of the invention which is defined solely by the claims appended hereto.

What is claimed is:

1. A system comprising:

produced gas a pipeline with gas at a lower pressure a manifold with flow control valve a reciprocating power unit a drive connection from power unit to a powered unit a flow-directing switching means which, in time with the drive's reciprocating movement to the end-point positions, switches communication of produced gas and pipeline with the appropriate sides of the power unit.

2. A system as in claim 1 where the flow-directing switching means comprises:

two opposed pistons tightly fitted and moveable in a linear fashion within closed cylinders each opposed piston connected to the other via a body between them which is itself tightly fitted and slideable within a fourth cylinder fixed to both of said opposed piston's cylinders said body having cavities which match with and form different conduits between five ports in said fourth cylinder at different orientations of said body within said fourth cylinder's wall, each port communicating with said manifold two flow control valves deployed in the manifold, each control valve to control the rate of gas flow between one side of the power unit's piston and one side of the matching one of said opposed pistons versus the other side of said opposed piston, to control the speed of reciprocation of said opposed pistons and said body.

3. A system as in claim 2 where:

when said opposed pistons are substantially at one extreme of their linear travel within their respective cylinders, said cavities and manifold form the following communications paths:

produced gas to the first side of said power unit piston and directly to one side of a matching one of said opposing pistons, and through flow-control valve to the other side of said one opposing piston the other side of said power unit piston and directly to one side of the matching second of said opposing pistons and, through the second flow-control valve from the other side of said second opposing piston, to pipeline such that the power unit piston is pushed in a direction from the produced gas side toward the pipeline side of its cylinder, providing power through its connecting rod to the powered unit, and such that:

the opposing piston communicating with pipeline is moved from its directly communicating side toward its flow-control communicating side and spent gas from the power unit's piston then flows to pipeline essentially simultaneously, the other opposing piston which is communication with produced gas is pushed from its directly communicating side toward its flow-control communicating side which until then had contained gas at lower pipeline pressures, and said body is moved toward one direction in relation to said ports to alter in a timed way the conduits thus formed within the manifold and ported cylinder and body so that at the other extreme of their linear travel within their respective cylinders is caused the communications paths as follows:

produced gas to the second side of said power unit piston and directly to one side of the matching second opposing piston and through the second flow-control valve to the other side of the second opposing piston the first side of said power unit piston and directly to one side of the matching first opposing piston and through the first flow-control valve to the other side of the first opposing piston, and to pipeline such that the power unit piston then is pushed in the other direction, providing repeatable reciprocating linear powered motion of said drive connection, and said reversed gas-flows provide realignment of said switching valve's internal body's cavities with said ports to cause the further repeated redirection of gas through the manifold.

4. The system described in claim 3 where the first and second flow-control valves may be independently adjusted to vary the timing of the reciprocation, each such valve controlling the rate of gas flow required to reach equilibrium between a produced gas side and a pipeline side of the power unit's piston for a different direction of said reciprocation.

5. The system of claim 1 which provides for the recirculation of spent-pressure exhaust gas under sufficient pressure to pipeline while providing reciprocating powered motion to an external powered device.

6. The system of claim 1 where the produced gas under pressure is from available sources at or near a natural gas producing well-head or battery, and may be well-head gas or other process gas under pressure where the pipeline with gas at lower pressure is likewise to a variety of destinations at or near the well-head or battery and may be to production pipeline or to any pipeline or destination carrying process gas which is at such lower pressure.

7. The system in claim 1 where the reciprocating power unit is either piston-driven or diaphragm driven by controlled gas pressure differential.

* * * * *